US009416493B2

(12) United States Patent
Hillebrand et al.

(10) Patent No.: US 9,416,493 B2
(45) Date of Patent: Aug. 16, 2016

(54) METHOD, SYSTEM AND APPARATUS FOR PROCESSING FIBRIL CELLULOSE AND FIBRIL CELLULOSE MATERIAL

(71) Applicant: UPM-KYMMENE CORPORATION, Helsinki (FI)

(72) Inventors: Kari Hillebrand, Jyskä (FI); Markus Nuopponen, Helsinki (FI); Martina Lille, Vantaa (FI); Juha Tamper, Levänen (FI)

(73) Assignee: UPM-KYMMENE CORPORATION, Helinski (FI)

( * ) Notice: Subject to any disclaimer, the term of this patent is extended or adjusted under 35 U.S.C. 154(b) by 0 days.

(21) Appl. No.: 14/378,407

(22) PCT Filed: Feb. 12, 2013

(86) PCT No.: PCT/FI2013/050157

§ 371 (c)(1),
(2) Date: Aug. 13, 2014

(87) PCT Pub. No.: WO2013/121104

PCT Pub. Date: Aug. 22, 2013

(65) Prior Publication Data

US 2015/0330023 A1 Nov. 19, 2015

(30) Foreign Application Priority Data

Feb. 13, 2012 (FI) ..... 20125153

(51) Int. Cl.

| | |
|---|---|
| ***D21H 11/18*** | (2006.01) |
| ***D21F 1/66*** | (2006.01) |
| ***D21F 5/00*** | (2006.01) |
| ***D21F 1/10*** | (2006.01) |
| ***D21C 9/18*** | (2006.01) |
| *D21H 25/04* | (2006.01) |
| *D21H 15/02* | (2006.01) |

(52) U.S. Cl.

CPC ..... *D21H 11/18* (2013.01); *D21C 9/18* (2013.01); *D21F 1/10* (2013.01); *D21F 1/66* (2013.01); *D21F 5/00* (2013.01); *D21H 15/02* (2013.01); *D21H 25/04* (2013.01)

(58) Field of Classification Search

USPC ..... 162/9, 1, 232, 261
IPC ..... D21H 11/18; D21F 5/00,1/00, 1/10, D21F 1/66
See application file for complete search history.

(56) References Cited

U.S. PATENT DOCUMENTS

| | | | |
|---|---|---|---|
| 4,481,077 | A | 11/1984 | Herrick |
| 5,964,983 | A | 10/1999 | Dinand et al. |
| 6,231,657 | B1 | 5/2001 | Cantiani et al. |
| 6,739,072 | B2 | 5/2004 | Knoer et al. |
| 2005/0067123 | A1 | 3/2005 | DeZutter et al. |
| 2010/0065236 | A1 | 3/2010 | Henriksson et al. |
| 2011/0260348 | A1 | 10/2011 | Gardner et al. |

FOREIGN PATENT DOCUMENTS

| | | | |
|---|---|---|---|
| EP | 0 120 471 | A2 | 10/1984 |
| EP | 1 553 103 | A1 | 7/2005 |
| EP | 2 226 171 | A1 | 9/2010 |
| JP | A-2010-209510 | | 9/2010 |
| WO | WO 99/24661 | A1 | 5/1999 |
| WO | WO 99/34057 | A1 | 7/1999 |
| WO | WO 2009/084566 | A1 | 7/2009 |
| WO | WO 2010/092239 | A1 | 8/2010 |
| WO | WO 2011/088889 | A1 | 7/2011 |

OTHER PUBLICATIONS

Kutcharlapati et al., "Influence of Nano Cellulose Fibres on Portland Cement Matrix," *Metals Materials and Process*, 2008, vol. 20, No. 3, pp. 307-314.

Office Action issued in Finnish Patent Application No. 20125153 dated Oct. 8, 2012.

International Search Report issued in International Patent Application No. PCT/FI2013/050157 dated Oct. 9, 2013.

*Primary Examiner* — Mark Halpern
(74) *Attorney, Agent, or Firm* — Oliff PLC

(57) ABSTRACT

The invention relates to a method for processing chemically modified fibril cellulose. The method includes introducing chemically modified fibril cellulose material to a thermal drying device including a belt in such a way that the fibril cellulose material forms at least one bar onto the belt, and dewatering the chemically modified fibril cellulose material on the belt using heated air flow having a temperature of at least 40 ° C. in order to concentrate and/or dry the chemically modified fibril cellulose material in such a way that the dry solids content of the fibril cellulose material after the thermal drying device is at least 10%. In addition, this invention relates to a thermal drying device, a system for processing chemically modified fibril cellulose, a method and a system for redispersing the fibril cellulose, and a fibril cellulose material.

15 Claims, 12 Drawing Sheets

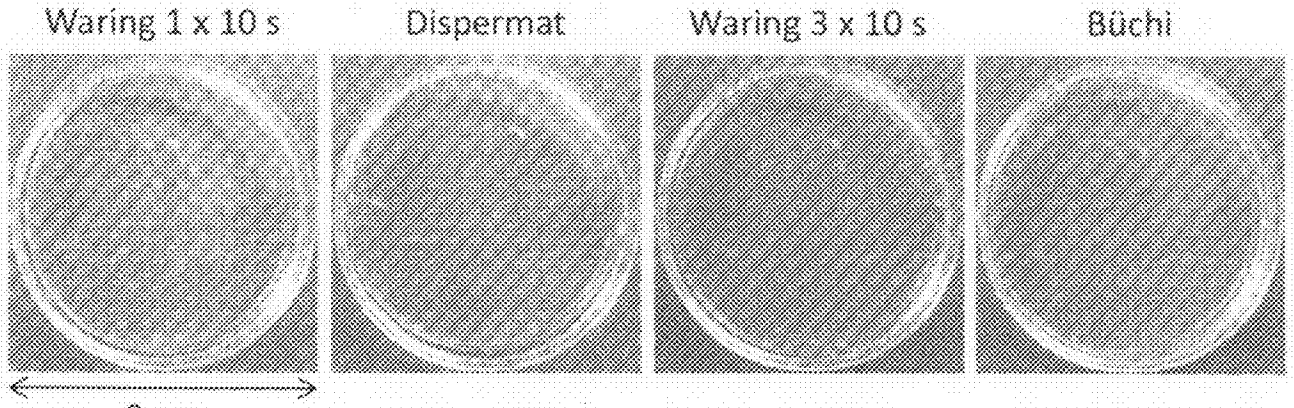
Fig. 12a
Fig. 12b
Fig. 12c
Fig. 12d
Fig. 13a
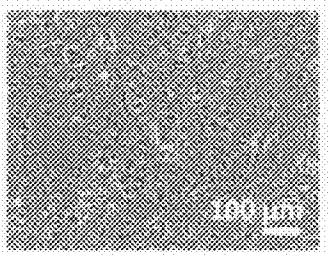
Fig. 13b
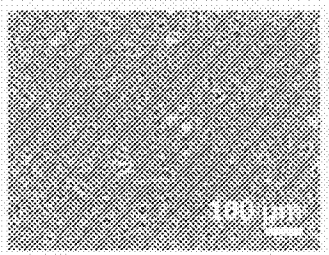
Fig. 13c
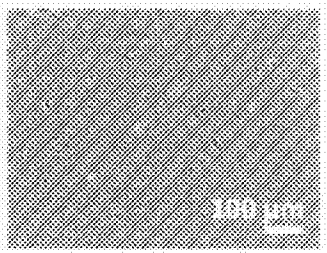
Fig. 13d

METHOD, SYSTEM AND APPARATUS FOR PROCESSING FIBRIL CELLULOSE AND FIBRIL CELLULOSE MATERIAL

This application is a 371 of PCT/FI2013/050157 filed 12 Feb. 2013.

FIELD OF THE INVENTION

This invention relates to a method, a system, and an apparatus for processing chemically modified fibril cellulose. In addition, this invention relates to a chemically modified fibril cellulose material.

BACKGROUND OF THE INVENTION

Cellulose is a polysaccharide consisting of a linear chain of several hundreds to ten thousand linked D-glucose units. Cellulose fibers can be, for example, refined with a refiner or a grinder to produce fibril cellulose material. Fibril cellulose refers to isolated cellulose microfibrils or microfibril bundles derived from cellulose raw material. Therefore, fibril cellulose, which is also known as nanofibrillar cellulose (NFC) and by other related names, is based on a natural polymer that is abundant in nature. Fibril cellulose has many potential uses for example based on its capability of forming viscous gel in water, i.e. hydrogel.

Typically production of fibril cellulose is done in very low consistency between 1 and 4%. Thus, a solution for drying is needed, for example, in order to transport material with reasonable costs. However, it is a well known fact that removing water from fibril cellulose is challenging. In addition, fibril cellulose may lose some needed properties due to hornification during drying. Therefore, especially redispersion of nanomaterial is challenging after drying.

SUMMARY OF THE INVENTION

The present invention discloses a method, a system and an apparatus for processing chemically modified fibril cellulose. In addition, the invention discloses a chemically modified fibril cellulose material.

Aspects of the invention are characterized by the following embodiments:

1. A method for processing chemically modified fibril cellulose, the method comprising
   - introducing chemically modified fibril cellulose material to a thermal drying device (20) comprising a belt (22) in such a way that the fibril cellulose material forms at least one bar onto the belt (22),
   - dewatering the chemically modified fibril cellulose material on the belt (22) using heated air flow having a temperature of at least 40° C. in order to concentrate and/or dry the chemically modified fibril cellulose material in such a way that the dry solids content of the fibril cellulose material after the thermal drying device (20) is at least 10%.

2. The method according to embodiment 1, characterized in that the belt is a wire and at least part of the heated air flows through the belt.

3. The method according to embodiments 1 or 2, characterized in that a viscosity of the fibril cellulose introduced to the thermal drying device (20) is at least 10000 mPas in a supplying consistency of said fibril cellulose, wherein dry matter content of said fibril cellulose is between 0.5-9%; preferably 1-7%; more preferably 2.5-5%.

4. The method according to any one of the preceding embodiments, characterized in that fibril cellulose material on the belt (22) of the thermal drying device (20) covers at least 30% of the drying area of the belt (22).

5. The method according to any of the preceding embodiments, characterized by
   - supplying the chemically modified fibril cellulose material to a feeding tank (24),
   - conveying the chemically modified fibril cellulose material from the feeding tank (24) to the thermal drying device (20), wherein a mono pump is used in the conveying process.

6. The method according to any of the preceding embodiments, characterized in that the thermal drying device (20) comprises at least two belts (22*a*, 22*b*, 22*c*) and at least one crushing device (21) and the dewatering comprises the following steps:
   - drying and/or concentrating the chemically modified fibril cellulose on the first belt (22*a*),
   - crushing the chemically modified fibril cellulose material in the crushing device (21) after the drying step on the first belt (22*a*), and
   - drying and/or concentrating the chemically modified fibril cellulose material on the second belt (22*b*, 22*c*) after the crushing step.

7. The method according to any of the preceding embodiments, characterized by
   - extruding the chemically modified fibril cellulose material onto the belt (22) by a nozzle forming the bar.

8. The method according to any of the preceding embodiments, characterized in that the bar is in the form of a string, and there is several strings on the belt (22), each of the strings having a diameter between 2 and 10 mm.

9. The method according to any of the preceding embodiments 1-7, characterized in that the bar is in the form of a layer comprising clippings, and a thickness of the layer is between 5 and 20 cm.

10. The method according to any of the preceding embodiments 1-7, characterized in that the bar is in the form of a single layer.

11. The method according to any of the preceding embodiments characterized in that the heated air is generated by means of a heat exchanger from waste heat of a pulp mill, steam or electric power.

12. The method according to any of the preceding embodiments, characterized by
   - pre-drying the chemically modified fibril cellulose in a predrying device (15) prior to the thermal drying device (20) in such a way that the dry matter content of the fibril cellulose introduced to the thermal drying device (20) is at least 5%.

13. A method for processing chemically modified fibril cellulose, the method comprising
   - introducing chemically modified fibril cellulose material having a dry solids content more than 10% to a hydration device (42),
   - redispersing the chemically modified fibril cellulose into liquid in an dispergator (44) in order to achieve chemically modified fibril cellulose having a dry matter content between 0.01 and 5%, more preferably between 0.1 and 1%.

14. The method according to embodiment 13, characterized by
   - wetting the chemically modified fibril cellulose material having a dry solids content more than 10% in the hydration device (42), and conveying the wetted chemically modified fibril cellulose material to the dispergator (44).

15. The method according to embodiments 13 or 14, characterized in that the redispersed fibril cellulose has the zero shear viscosity of 1000 to 50000 Pas and yield stress of 1-30 Pa, preferably 3-15 Pa as measured at 0.5% concentration in water.

16. The method according to embodiments 13, 14 or 15, characterized in that the fibril cellulose will give, when redispersed in water, viscosity that is at least 60%, more preferably at least 70% of the original viscosity at the same dispergation concentration.

17. A system for processing chemically modified fibril cellulose, the system comprising a thermal drying device (20) comprising at least one belt (22), at least one feeding device (31) to introduce chemically modified fibril cellulose to the thermal drying device (20) in such a way that the chemically modified fibril cellulose material forms at least one bar onto the belt (22), means (32) for forming heated air flow having a temperature at least 40° C. in order to concentrate and/or dry the chemically modified fibril cellulose material on the belt (22) using the heated air flow.

18. A system for processing chemically modified fibril cellulose, the system comprising a hydration device (42), at least one feeding device (41*a*) to supply the chemically modified fibril cellulose having a dry matter content of at least 10% to the hydration device (42), a dispergator (44) in order to achieve chemically modified fibril cellulose having a dry matter content between 0.01 and 5%, more preferably between 0.1 and 1%, and means (41*b*) for conveying the wetted fibril cellulose material from the hydration device (42) to the dispergator (44).

19. A thermal drying device for processing chemically modified fibril cellulose, the thermal drying device (20) comprising at least two belts (22*a*, 22*b*, 22*c*), at least one crushing device (21) that is placed between the at least two belts, means for supplying heated air flow through the thermal drying device in in order to concentrate and/or dry the chemically modified fibril cellulose material.

20. A chemically modified fibril cellulose having a dry solids content of at least 10% and in which the size of the clippings is 5 mm at the most.

21. A chemically modified fibril cellulose that is redispersable in water, wherein the fibril cellulose is redispersed from chemically modified fibril cellulose having a dry solids content at least 10%, the redispersed chemically modified fibril cellulose having the following properties:

charge ieq/g(fibril cellulose) between −200 and −2000 and Brookfield viscosity measured at 10 rpm more than 5000 mPas when measured at 0.8% concentration, and turbidity measured by nephelometer at 0.1% concentration less than 200, or charge ieq/g(fibril cellulose) between 300 and 2000 and Brookfield viscosity measured at 10 rpm more than 5000 mPas when measured at 0.8% concentration, and turbidity measured by nephelometer at 0.1% concentration less than 100.

22. The chemically modified fibril cellulose according to embodiment 21, characterized in that the charge ieq/g(fibril cellulose) of the redispersed chemically modified fibril cellulose is between −500 and −1500, the turbidity measured at 0.1 concentration is between 10 and 60 NTU, and the Brookfield viscosity measured at 0.8% concentration at 10 rpm is between 10 000 and 40 000 mPas.

23. A chemically modified fibril cellulose manufactured according to any of the preceding embodiments 1 to 12 or 13 to 16.

In an embodiment, the method for processing chemically modified fibril cellulose comprises at least one step wherein the chemically modified fibril cellulose material is concentrated and/or dried on a belt using heated air flow, more preferably the method comprises at least two steps wherein the chemically modified fibril cellulose material is concentrated and/or dried on a belt using heated air flow. In an example, the method comprises at least one pre-treatment step, wherein the dry matter content of the chemically modified fibril cellulose is mechanically increased before the chemically modified fibril cellulose is supplied onto the belt.

Advantageously, the system for processing chemically modified fibril cellulose comprises a thermal drying device comprising a belt, a feeding device to introduce chemically modified fibril cellulose to the thermal drying device in such a way that the chemically modified fibril cellulose material forms at least one bar onto the belt, means for forming heated air flow having the temperature of at least 40° C. in order to concentrate and/or dry the chemically modified fibril cellulose material on the belt using the heated air flow.

If thermal drying is attempted in one step, the surface of the chemically modified fibril cellulose bar may harden in such a way that the product remains wet inside. Because of this, advantageously at least one intermediate crushing step is used for an even drying result of the fibril cellulose. If there are more intermediate crushing steps, the quality of the product may be improved. Therefore, there are advantageously at least two drying steps in the thermal drying process between which is at least one crushing device.

Advantageously, the first belt of the thermal drying device comprises a blade, for example a doctor blade, which is arranged to release the fibril cellulose bar from the surface of the belt.

There may be one fibril cellulose bar in the form of layer and/or several fibril cellulose bars in the form of strings on the first belt. Alternatively, if the fibril cellulose is dry enough, there may be several clippings forming a layer on the first belt.

Advantageously, there are several strings on the first belt. Especially if a pre-drying device is not used, the dosed bars are preferably in the form of strings in the first thermal drying step. Advantageously, clippings are cut from the fibril cellulose strings between the first belt and the second belt, after which a layer is formed from the clippings on the second belt. Advantageously, the bars are in the form of multi-layer clippings in at least the last drying step.

Preferably, the fibril cellulose material cover at least 30% or at least 45%, more preferably at least 60% or at least 70% and most preferably at least 80% or at least 90% of the drying area of the belt, also in the case of the first belt.

After the last belt of the thermal drying device, the concentrated and/or dried chemically modified fibril cellulose may further be crushed and homogenized into the desired clipping size. The average diameter of the concentrated and/or dried chemically modified fibril cellulose material (i.e. clippings) is preferably between 1 and 10 mm. After this, the dried and/or concentrated chemically modified fibril cellulose material may be moved, for example, to a storage or a bagging stage to wait for a possible transport to the site of use.

The fibril cellulose used in the present invention is chemically modified, i.e. cationic fibril cellulose or anionic fibril cellulose, in order to achieve needed redispersing properties. Thus, the cellulose molecules in the fibril cellulose according to the present invention contain some additional functional groups when compared with the chemical structure of native cellulose. Such groups can be, by way of example only, carboxymethyl, aldehyde and/or carboxyl or quaternary ammonium. The chemical modification is preferably based on carboxymethylation, oxidation, esterification, or etherification reaction of cellulose molecules. In an example, modification is realized by physical adsorption of anionic, cationic, or non-ionic substances or any combination of these on cellulose surface. The described modification can be carried out before, after, or during the production of microfibrillar cellulose, or any combination of these processes.

The fibril cellulose can be made of cellulose which is chemically pre-modified to make it more labile. The starting material of this kind of nanofibrillated cellulose is labile cellulose pulp or cellulose raw material, which results from certain modifications of cellulose raw material or cellulose pulp. For example N-oxyl mediated oxidation (e.g. 2,2,6,6-tetramethyl-1-piperidine N-oxide) leads to very labile cellulose material, which is easy to disintegrate to microfibrillar cellulose. For example patent applications WO 09/084566 and JP 20070340371 disclose such modifications. Alternatively, the chemically modified fibril cellulose can be made of, for example, lightly carboxymethylated cellulose material.

If cationic fibril cellulose is used, cationic cellulose is advantageously prepared by using glycidyltrimethylammonium chloride (GTAC, M=151.46 g/mol) as a reagent to substitute cellulose. Cationic fibril cellulose typically has a zeta potential of at least 10 mV (pH 8). The degree of polymerization (DP) is preferably at least 0.05.

According to the present invention, the dry solids content after thermal drying is preferably between 10 and 100%, more preferably between 20 and 50%.

Advantageously, the concentrated and/or dried chemically modified fibril cellulose is redispersed in such a way that the viscosity of the original non-concentrated material is fully or almost reached after redispersion, which may lead to equal or almost equal properties when compares to the original fibril cellulose.

Advantageously, the chemically modified fibril cellulose is concentrated and/or dried. The dry solids content of the chemically modified fibril cellulose prior drying is typically between 1 and 4%, which is too low for some applications where large amounts of water cannot be accepted.

The thermal drying device enables thermal drying of the chemically modified fibril cellulose. Therefore, the invention enables, among other things, cost-effective transportation to final utilization site and redispersion of the dried chemically modified fibril cellulose retaining the original characteristics of the matter.

Advantageously, a redispersion method comprises the following steps:

introducing chemically modified fibril cellulose material having a dry solids content more than 10% to the system, redispersing the chemically modified fibril cellulose into liquid in an dispergator in order to achieve chemically modified fibril cellulose having a dry matter content between 0.01 and 5%, more preferably between 0.1 and 1%.

In an advantageous embodiment, the redispersion method comprises the following steps:

introducing chemically modified fibril cellulose material having a dry solids content more than 10% to the system, wetting the chemically modified fibril cellulose material having a dry solids content more than 10% in a hydration tank, conveying the wetted chemically modified fibril cellulose material to the dispergator, and redispersing the chemically modified fibril cellulose into liquid in an dispergator in order to achieve chemically modified fibril cellulose having a dry matter content between 0.01 and 5%, more preferably between 0.1 and 1%.

Advantageously, the redispersed fibril cellulose will give viscosity that is at least 60% or at least 70%, more preferably at least 80% or at least 85% and most preferably at least 90% or at least 95% of the original viscosity at the same dispergation concentration.

DESCRIPTION OF THE DRAWINGS

In the following, the invention will be illustrated by drawings in which

FIGS. 6-7 show photos from experimental tests, wherein FIG. 6 shows extruded material on a wire, FIGS. 8-13 show results from experimental tests, wherein FIG. 8 shows viscosity vs. shear stress curves of modified fibril cellulose dispersions made of non-concentrated (2%) or concentrated (26%) anionic fibril cellulose, FIG. 9 shows the effect of the redispersion method on flow behaviour of 0.5% fibril cellulose dispersions prepared from non-concentrated (3.6%) or concentrated (22%) anionic fibril cellulose, FIG. 10 shows the effect of the hydration temperature on the flow behaviour of fibril cellulose dispersions made of dried (100%) anionic fibril cellulose in comparison with the flow behaviour of a dispersion made of non-concentrated material, FIG. 11 shows the flow behaviour of the dispersions prepared by various redispersion methods from material air-dried to 27%, FIG. 12 shows photographs of a thin layer of 0.5% (w/w) anionic fibril cellulose dispersions prepared by various redispersion methods from material air-dried to 27%, and FIG. 13 shows phase contrast micrographs of the dispersions prepared by various redispersion methods from material air-dried to 27%.

DETAILED DESCRIPTION OF THE INVENTION

Figure 1:
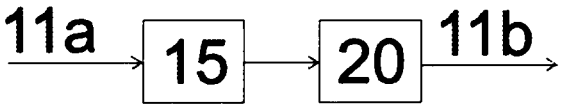
FIG. 1 shows an example of the drying process.

In the following disclosure, all percentages are by dry weight, if not indicated otherwise.

The following reference numbers are used in this application:

11 chemically modified fibril cellulose material,

11*a* chemically modified fibril cellulose material to be concentrated and/or dried,

11*b* concentrated and/or dried fibril cellulose material,

11*c* redispersed fibril cellulose material,
15 pre-drying device,
20 thermal drying device,
21 crushing device,
21*a* first crushing device,
21*b* second crushing device,
21*c* third crushing device,
22 belt,
22*a* first belt,
22*b* second belt,
22*c* third belt,
23 heated air,
24 feeding tank for the thermal drying device,
25 conveyor from the thermal drying device,
26 feeding pump, such as a mono pump,
31 feeding device of the thermal drying device, such as an extruder,
32 means for forming heated air flow,
40 means for redispersing chemically modified fibril cellulose material,
41*a* first conveying means of the redispersion process for feeding concentrated chemically modified fibril cellulose 11*b* to a hydration tank,
41*b* second conveying means of the redispersion process for conveying the chemically modified fibril cellulose from the hydration tank to the dispergator 44,
41*c* third conveying means of the redispersion process for conveying the chemically modified fibril cellulose from the dispergator 44,
42 hydration (i.e. wetting) device, such as a hydration tank,
44 dispergator,
45 fibril cellulose storage tank for the redispersed fibril cellulose, and
46 heated dilution water.

Cellulose is a renewable natural polymer that can be converted to many chemical derivatives. The derivatization takes place mostly by chemical reactions of the hydroxyl groups in the β-D-glucopyranose units of the polymer. By chemical derivatization the properties of the cellulose can be altered in comparison to the original chemical form while retaining the polymeric structure.

In this application, the term fibril cellulose "bar" refers to a fibril cellulose string, fibril cellulose clippings, and a plate-like form, i.e. a fibril cellulose layer.

The term "drying area of a belt" refers to the area of the belt in which the fibril cellulose material is meant to be placed during a drying step on the belt.

The term "fibril cellulose" refers to a collection of isolated cellulose microfibrils or microfibril bundles derived from cellulose raw material. The fibril cellulose consists of cellulose fibrils whose diameter is in the submicron range. It forms a self-assembled hydrogel network even at low concentrations. These gels of fibril cellulose are highly shear thinning and thixotropic in nature. The fibrils have typically high aspect ratio: the length might exceed one micrometer while the number-average diameter is typically below 200 nm. The diameter of microfibril bundles can also be larger but generally less than 1 μm. The smallest microfibrils are similar to so called elementary fibrils, which are typically 2-12 nm in diameter. The dimensions of the fibrils or fibril bundles are dependent on the raw material and disintegration method. The fibril cellulose may also contain some hemicelluloses; the amount is dependent on the plant source. Mechanical disintegration of fibril cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer or fluidizer-type homogenizer.

There are several widely used synonyms for fibril cellulose. For example: nanofibrillated cellulose (NFC), nanocellulose, microfibrillar cellulose, nanofibrillar cellulose, cellulose nanofiber, nano-scale fibrillated cellulose, microfibrillated cellulose (MFC), or cellulose microfibrils. Fibril cellulose described in this application is not the same material as the so called cellulose whiskers, which are also known as: cellulose nanowhiskers, cellulose nanocrystals, cellulose nanorods, rod-like cellulose microcrystals or cellulose nanowires. In some cases, similar terminology is used for both materials, for example by Kuthcarlapati et al. (Metals Materials and Processes 20(3):307-314, 2008), where the studied material was called "cellulose nanofiber" although they clearly referred to cellulose nanowhiskers. Typically these materials do not have amorphous segments along the fibrillar structure as fibril cellulose, which leads to a more rigid structure. Cellulose whiskers are also shorter than fibril cellulose.

The fibril cellulose is prepared normally from cellulose raw material of plant origin. The raw material can be based on any plant material that contains cellulose. The term cellulose raw material refers to any cellulose raw material source that can be used in the production of chemically and/or mechanically treated cellulose fibers. The plant material may be wood. The wood can be from softwood trees such as spruce, pine, fir, larch, douglas-fir or hemlock, or from hardwood trees such as birch, aspen, poplar, alder, eucalyptus or acasia, or from a mixture of softwood and hardwood. Nonwood material can be from agricultural residues, grasses or other plant substances such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed. The term chemical pulp refers to cellulose fibers, which are isolated from any cellulose raw material or any combination of cellulose raw materials by a chemical pulping process.

Therefore, lignin is at least for the most part removed from the cellulose raw material. Chemical pulp is preferably sulfate wood pulp. In an example, the chemical pulp is isolated from softwood and/or from hardwood. The used chemical pulp may be unbleached or bleached. In an embodiment, at least 80% of dry weight, more preferably at least 90% of dry weight and most preferably at least 95% of dry weight of the fibril cellulose material used in this invention is from chemical pulp.

The fibril cellulose material used in this invention is a chemically modified derivate of cellulose nanofibrils or nanofibril bundles. The chemical modification may be based, for example, on carboxymethylation, oxidation, esterification, or etherification reaction of cellulose molecules. Modification may also be realized by physical adsorption of anionic, cationic, or non-ionic substances or any combination of these on cellulose surface. The described modification can be carried out before, after, or during the production of microfibrillar cellulose, or any combination of these processes.

Advantageously, the fibril cellulose material used in this invention is produced from anionized or cationized cellulose material, i.e. the fibril cellulose is anionic or cationic. The anionization of the cellulose material may be implemented, for example, by a reaction wherein the primary hydroxyl groups of cellulose are oxidized catalytically by a heterocyclic nitroxyl compound, or by a reaction wherein cellulose material is reacted with the carboxymethylating agents to form lightly carboxymethylated cellulose.

Therefore, in an embodiment of the invention, cellulose material is oxidized by nitroxyl-mediated oxidation of hydroxyl groups of the cellulose in order to achieve anionized cellulose material. In this case, the anionization of the cellulose material is preferably implemented by a reaction wherein the primary hydroxyl groups of cellulose are oxidized catalytically by a heterocyclic nitroxyl compound. The chemical may be, for example, so called "TEMPO" chemical, i.e. 2,2,6,6-tetramethylpiperidinyl-1-oxy free radical. Other heterocyclic nitroxyl compounds known to have selectivity in the oxidation of the hydroxyl groups of C-6 carbon of the glucose units of the cellulose can also be used.

In another embodiment of the invention, cellulose material is reacted with carboxymethylating agents in order to achieve anionized cellulose material. In this embodiment, cellulose material is reacted with the agents to form lightly carboxymethylated cellulose material having such a degree of substitution that it is not soluble in water.

In another embodiment of the invention, cationic cellulose material is prepared by using glycidyltrimethylammonium chloride.

Advantageous characterization for the fibril cellulose is presented in Table 1.

TABLE 1

Characterization for the fibril cellulose

| Grade | Brookfield viscosity (mPas) | Turbidity (NTU) | Charge (ieq/$g_{fibril\ cellulose}$) |
|---|---|---|---|
| anionic fibril cellulose | >5 000, preferably between 10 000 and 40 000 | <200 Preferably between 20 and 100 | between −200 and −2000, preferably between −500 and −1500, more preferably between −600 and −1200, most preferably between −800 and −1000 |
| cationic fibril cellulose | >5 000, preferably between 20 000 and 40 000 | <100 Preferably between 25 and 70 | between 300 and 2000, preferably between 500 and 1500, more preferably between 700 and 1200, most preferably between 800 and 1000 |

Viscosity of the fibril cellulose (as shown in Table 1): There are several commercial Brookfield viscosimeters available for measuring apparent viscosity, which are all based on the same principle. For the measurement disclosed in Table 1, so called Brookfield RVDV-III—device is used. A low rotation speed at 10 rpm should be selected. Differences in rotational speed may give false viscosity values. In addition, a "vane spindle" (number 73 in the device) is used because of its vane geometry, which is particularly suitable for testing heterogeneous viscous materials. The viscosity of anionized fibril cellulose should be measured at 0.8% concentration. The mixing time of the sample before the measurement is 10 minutes. The temperature used is 20° C.±1° C. Attention should also be paid to obtaining dilutions of fibril cellulose having constant standard concentration to be able to compare the results correctly. Further, flocking should be avoided.

Turbidity of the fibril cellulose (as shown in Table 1): The units of turbidity from a calibrated nephelometer are called Nephelometric Turbidity Units (NTU). Turbidity is measured using an optical method, wherein so called turbidimetry and nephelometry are used. The measurement is carried out at 0.1% concentration using so called HACH P2100-device. A fibril cellulose sample is diluted with water is such a way that 299.5 g water and 0.5 g fibril cellulose (calculated as dry fibril cellulose) are mixed carefully. Typically fibril cellulose is substantially transparent in an aqueous medium. More fibrillated cellulose materials have lower turbidity values when compared to less fibrillated ones.

Charge of the fibril cellulose (as shown in Table 1): The charge can be determined by conductometric titration. Advantageously the charge ieq/g (fibril cellulose) is between −200 and −2000, or between 300 and 2000, more preferably between −500 and −1500 or between 500 and 1500, and most preferably between −600 and −1200 or between 700 and 1200. In other words, fibril cellulose is preferably clearly anionic or cationic.

The yield stress (Pa) can be measured by so called rheometer-device or, for example, so called Brookfield-device. In an example, yield stress is more than 4 Pa, more preferably between 10 and 40 Pa.

In fibril cellulose production, the concentration of fibril cellulose is typically very low, usually between 1 and 4%. Therefore the logistic costs are typically too high to transport the material from the production site and a solution for drying is needed to transport material in reasonable price. According to the present invention, it is possible to avoid transportation of low solids fibril cellulose having the consistency of 5% at the most. Moreover, drying and/or concentration of the fibril cellulose is a necessity for some applications.

The specific surface area of fibril cellulose is very large due to its nanoscopic dimensions. Strong water retention is natural for fibril cellulose since water is bound on the surfaces of the fibers through numerous hydrogen bonds. Typically fibril cellulose loses some of the wanted properties due to hornification during drying. Therefore, especially redispersion of nanomaterial is challenging.

Thanks to the present invention, it is possible to concentrate chemically modified fibril cellulose material in such a way that the concentrated chemically modified fibril cellulose, whether dry or semidry, can be fully or almost fully redispersed in water or another solvent.

FIG. 1 shows an example embodiment for concentrating and/or drying chemically modified fibril cellulose in a reduced schematic chart, which process can be applied in industrial scale. In the process at least some water is evaporated by heated air. The chemically modified fibril cellulose material 11*a* to be concentrated and/or dried is fed to the thermal drying device 20.

In an example embodiment, the chemically modified fibril cellulose is manufactured in such a way that the dry matter content of the chemically modified fibril cellulose is more than 5% before thermal drying process.

There may be at least one pre-drying device 15 before the first drying step in the thermal drying device 20. The pre-drying device 15 is preferably a mechanical water removal-device, such as a pressure filtration device. Thanks to the pre-drying device 15, the dry solids content of the chemically modified fibril cellulose material 11*a* can be increased before the first drying step in the thermal drying device 20. However, in an example, no mechanical water removal is used.

Figure 2:
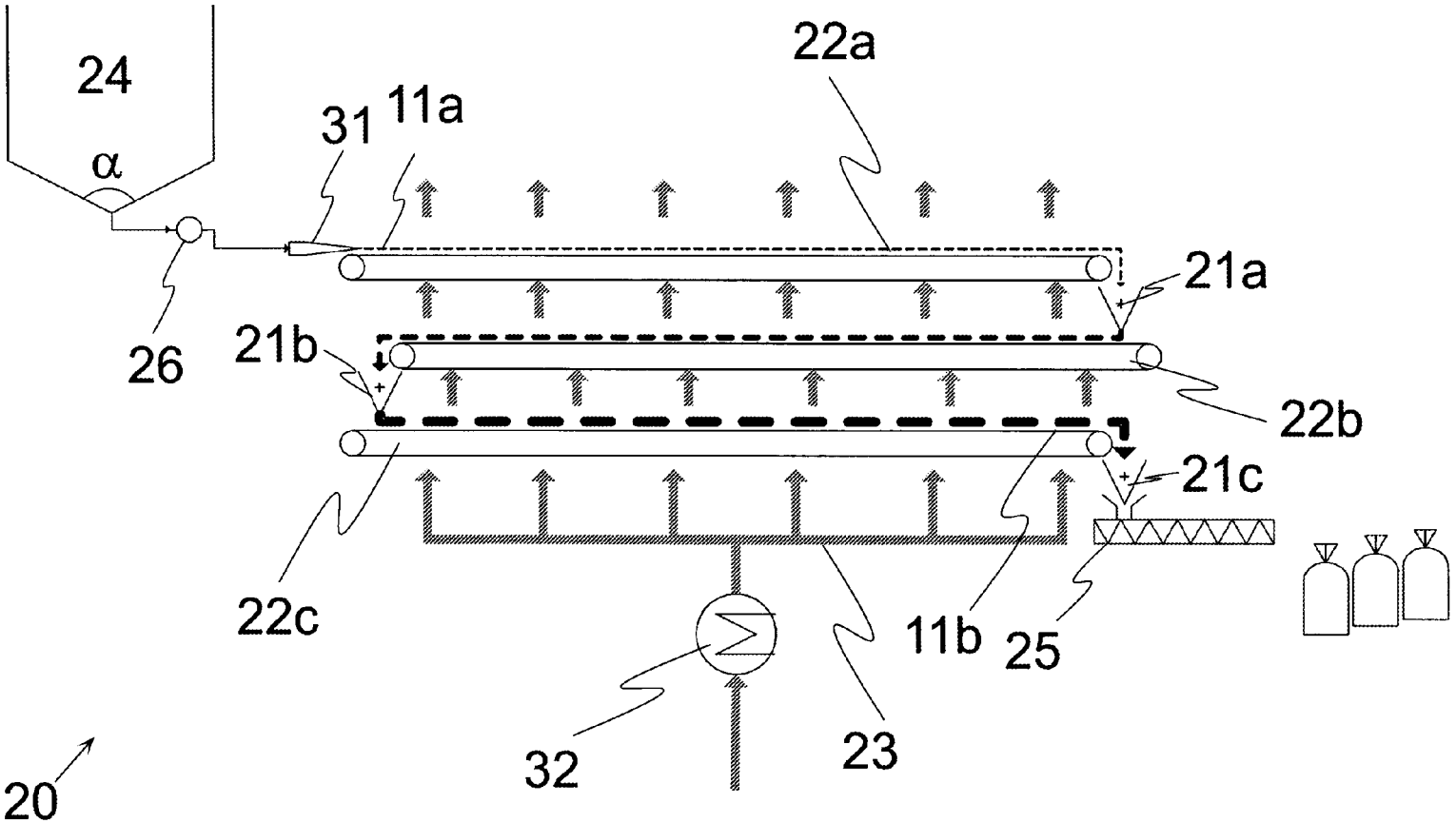
FIGS. 2-3 show example embodiments of the thermal drying process and the thermal drying apparatus used therein.
Figure 3:
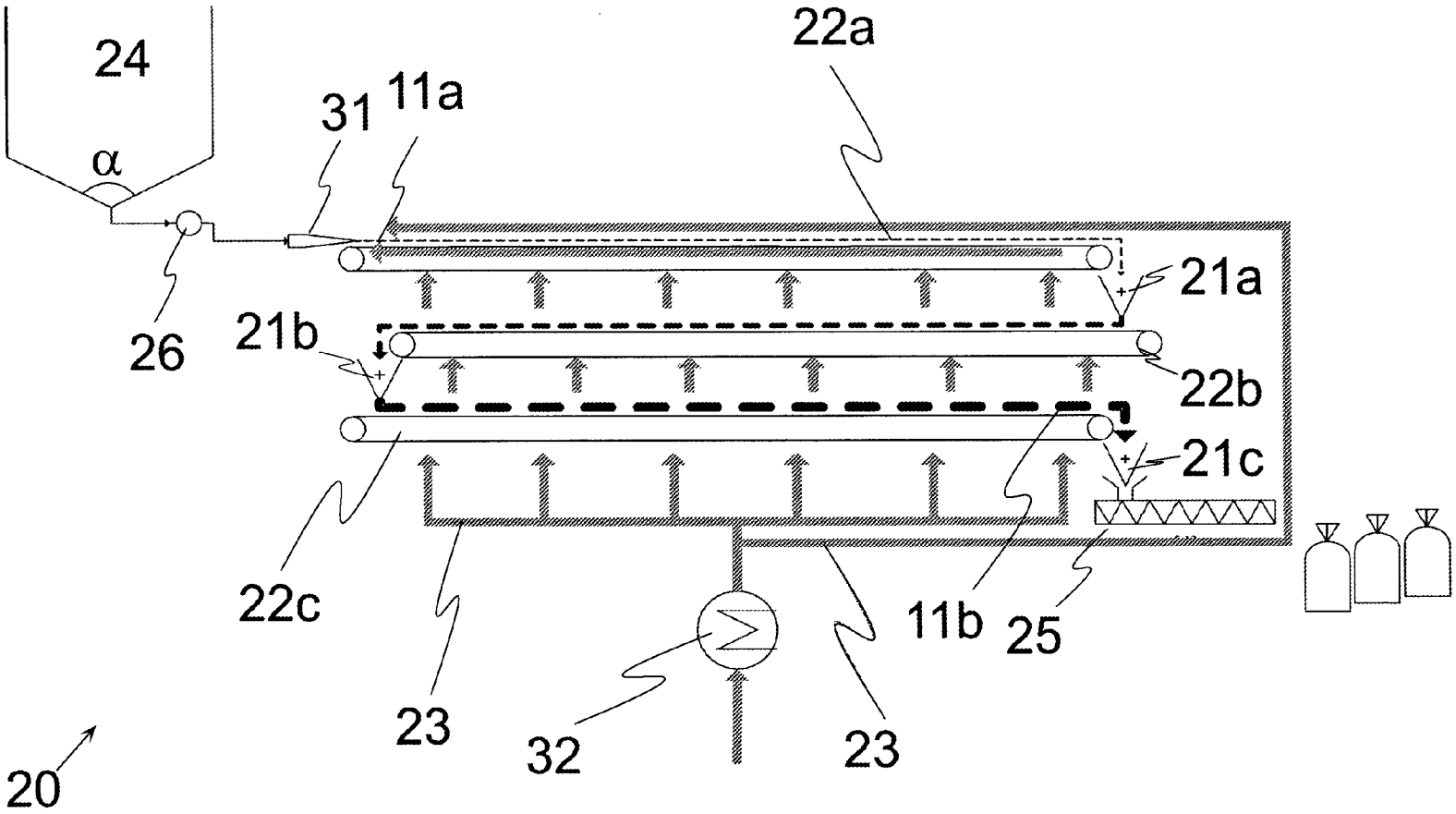

FIGS. 2 and 3 disclose advantageous embodiments of the thermal drying process. Advantageous air flows for drying string-like chemically modified fibril cellulose (on the first belt) is shown in FIG. 2, and advantageous air flows of drying layer-like chemically modified fibril cellulose (on the first belt) are shown in FIG. 3.

In an example, only one belt is used. In this case, the belt typically needs quite a large area to concentrate and/or dry the chemically modified fibril cellulose on the belt. Therefore, the capacity in single layer drying may remain too small. It is possible to increase the load of the chemically modified fibril cellulose material and hence to increase the drying capacity by multi-layered drying. This may be important to optimize the maximum load of the drying layer to minimize the drying costs. Therefore, a two-belt or a multiple-belt thermal drying device is more preferably used than a one-belt thermal drying device. By using a multiple-belt drying device, high drying capacities may be achieved on small base areas.

The thermal drying device preferably comprises at least two belts, for example from 2 to 4 belts, more preferably at least three belts, for example from 3 to 6 belts. The speed of each belt may be controlled, for example, by a frequency converter. Thus the thermal drying device can be adjusted optimally to the product to be dried.

A steep moisture gradient may develop in the chemically modified fibril cellulose material layer if the chemically modified fibril cellulose layer is not mixed in some occasion during the thermal drying. The thermal drying of the material may start from the first side, i.e. the side from which the air is blowing, and proceed through the material to the second side of the layer. Advantageously, there is a crushing device between two belts, therefore, the moisture in products with a long retention time is distributed especially homogenously because of the multiple mixing when the product is delivered onto the following belts.

Advantageously, the first belt of the thermal drying device comprises a blade, for example a doctor blade, which is arranged to release the fibril cellulose bar from the surface of the belt. The blade preferably releases the fibril cellulose material in the end of the first belt, for example within the area comprising the last 15%, more preferably the last 10% and most preferably the last 5% of the drying area of the first belt. After the drying step on the first belt of the thermal drying device, the fibril cellulose material preferably falls into the crushing device that is advantageously placed between the first belt and the second belt.

Advantageously, the thermal drying device 20 comprises at least one crushing device 21, for example 1 to 5 crushing devices 21, more preferably 2 to 4 crushing devices 21. This may increase the homogeneity of the concentrated chemically modified fibril cellulose. The particle size of the concentrated chemically modified fibril cellulose pieces typically decreases after each of the crushing devices. The crushing device(s) is (are) preferably placed between two belts, i.e. between two thermal drying steps.

In the thermal drying device 20, heated air flows preferably through the belt and the chemically modified fibril cellulose material bar(s) therein. Alternatively or in addition, it is also possible to use so-called recirculation air drying, wherein air flows along the surface of the belt and the chemically modified fibril cellulose therein. At least one drying step is implemented by using the thermal drying device 20. It is also possible that all drying steps are implemented by using the thermal drying device 20.

There is preferably at least one feeding tank 24 of the chemically modified fibril cellulose 11*a* for the thermal drying device 20. The feeding tank 24 is preferably a conic bottom tank, i.e. tank is tapering in its lower part. An angle $\alpha$ of the bottom of the conical tank 24 is preferably 120° at the most, for example between 80 and 120°, more preferably between 90 and 110°.

There is preferably a mixing device in the conic bottom tank. The rotation of the mixing device may be substantially slow, Advantageously the mixing device is placed in the vertical middle line of the tank 24. The mixing device is preferably attached to the bottom and, in addition, to the top of the feeding tank 24.

There may be a blade-kind of part in the upper part of the mixing device. Alternatively or in addition there may be spiral-kind of part in the upper part of the mixing device. The term "upper part" of the mixing device refers to the part placed in the upper part of the feeding tank 24, i.e. the part of the feeding tank having typically vertical walls.

There is preferably a screw-like mixing part in the lower part of the mixing device, wherein the screw-like mixing part in the lower part of the mixing device conveys the fibril cellulose material towards the bottom of the tank. The lower part refers to the conical bottom-part of the feeding tank 24. The rotation speed of the screw-like mixing part of the mixing device should be high enough in order to feed as much material as needed to the bottom of the feeding tank.

The fibril cellulose material is preferably discharged as a continuous volume flow from the feeding tank 24. There is preferably a discharging device in the conical part of the feeding tank 24, preferably at the bottom of the feeding tank, most preferably in the middle of the bottom of the feeding tank 24.

From the feeding tank 24 the chemically modified fibril cellulose 11*a* is pumped preferably by a pump 26 comprising a screw. Advantageously, the pump is a mono pump. These kinds of pumps are manufactured by, for example, AxFlow and Seepex Gmbh.

The feeding from the feeding tank 24 to the pump 26 may be implemented, for example, using a screw. In addition, the mono pulp preferably comprises a screw. From the mono pump, the fibril cellulose material is conveyed to the feeding device 31 that is preferably an extruder.

Advantageously, the dry matter content of the chemically modified fibril cellulose to be supplied to the thermal drying device is between 0.5 and 9%, for example between 1 and 7% or between 2.5 and 5%.

If high concentration of the chemically modified fibril cellulose 11*a* is reached before the thermal drying device 20, it is possible to form a thick drying layer directly to the first belt of the thermal drying device 20, and thus, the drying of strings is not required first, in which case the thermal drying may comprise only one drying step.

Advantageously, the viscosity of the supplied chemically modified fibril cellulose 11*a* in the supplying consistency is at least 10 000 mPas, more preferably at least 20 000 mPas, and most preferably at least 40 000 mPas or at least 50 000 mPas, which may be the most sensible operation range. If the viscosity of the chemically modified fibril cellulose 11*a* is low, the chemically modified fibril cellulose 11*a* may flow inside the first belt in the case of a wire, and hence it may be difficult to remove the chemically modified fibril cellulose from the wire.

Due to the high viscosity properties of the fibril cellulose material, it can be supplied as bars onto the belt of the used thermal drying device. The feeding of the bars is preferably based on an extruder technology. The feeding device 31 may be a combination of a pipe and pump, more preferably the feeding device is an extruder. If a plate-like product (i.e. a layer) is desired, the nozzle of the feeding device 31 is flat and wide, and for a string-like product, the nozzle of the feeding device is roundish.

If the dry solids content of the fibril cellulose material is not high enough, it may be hard to extrude the fibril cellulose material layer on the belt 22 of the thermal drying device. In this case, a pre-drying device 15 and/or a first drying step with the strings is preferably used.

With the feeding device 31, the chemically modified fibril cellulose 11*a* is distributed preferably on a moving belt. i.e. a first belt, either as strings preferably having a diameter between 2 and 20 mm or as a thin layer preferably having a thickness between 1 and 20 mm.

If the chemically modified fibril cellulose has high dry solids content of at least 5%, for example due to the pre-drying step based on pressing, a relatively thick drying layer, preferably between 5 and 10 cm may be formed directly on the first wire of the thermal drying device. The thickness of the chemically modified fibril cellulose layer to be concentrated may be increased along with the increased dry solids content of the chemically modified fibril cellulose on the following wires. If the dry matter content of the chemically modified fibril cellulose to be applied onto the first wire of the thermal drying device is 5% at the most or 4% at the most, advantageously strings are made from the chemically modified fibril cellulose 11*a* on the first belt of the thermal drying device. On the following belt(s) a relatively thick drying layer, for example, from 5 to 20 cm, more preferably 15 cm at the most, and most preferably 10 cm at the most, can be formed. In some cases if a thicker layer, for example approximately 30 cm, is formed, the back pressure may become too big.

The thermal drying device 20 used for the thermal drying step comprises preferably at least one belt 22 onto which the chemically modified fibril cellulose material 11*a* to be concentrated and/or dried is applied. Advantageously, at least the first belt 22*a* and/or at least the last belt is a wire, more preferably all belts 22 are wires. Advantageously, the chemically modified fibril cellulose 11*a* is supplied onto the first belt 22*a* of the thermal drying device 20. From the first belt 22*a* the chemically modified fibril cellulose is supplied onto a second belt 22*b*, preferably via a first crushing device 21*a*. From the second belt 22*b*, the chemically modified fibril cellulose is preferably supplied onto a third belt 22*c*, most preferably via a second crushing device 21*b*. There may also be more than three belts. In this case, there is preferably a crushing device also between the following drying steps. Advantageously after the last belt, the chemically modified fibril cellulose is fed to the last crushing device, after which the chemically modified fibril cellulose is preferably fed to a conveyer 25. Preferably the conveyer 25 conveys the fibril cellulose to a fibril cellulose packing device and/or to fibril cellulose storage.

The belt 22 used preferably comprises polyethylene and/or nylon. More preferably the belt 22 is made of polyethene and/or nylon. For example, typical paper machine wire materials are suitable for this. In an example, the belt 22 comprises steel and/or teflon. The mesh size of the wire used may vary a great deal, but the higher the viscosity in the original pulp is, the coarser a wire may be used.

In an example, the size of the openings (at least most of the openings) in the drying area of the wire is between 0.02 $mm^2$ and 0.05 $mm^2$. The sum of the openings (i.e. total area of the openings in the drying area of the belt) is preferably between 25 and 45% of the drying area of the wire.

In an example, the air permeability of the drying area of the wire is between 5000 and 6000 $m^3/m^2/h$.

It is easier to remove the product from a more dense wire than from a coarse wire, but a more dense wire reduces the air flow through the wire. Advantageously, heated air flows within the thermal drying device through the belt 22 and, in addition, preferably through the fibril cellulose on said belt. In an example, at least one belt 22 is heated.

The first belt 22*a* is preferably a porous wire in string-like drying, and air flows through the wire as shown in FIG. 2. In layer-like drying on the first belt 22*a*, as shown in FIG. 3, there may be, alternatively to a porous wire material, a dense material as well, in which case the drying of the fibril cellulose on the first belt 22*a* takes place mainly from one direction only. Advantageously, all belts are wires, and the first wire is advantageously of a more dense structure than the other wires.

The drying area of the belt 22 depends on the capacity wanted. The fibril material to be dried is preferably in contact with the belt(s) 22 used at least 10 minutes, more preferably at least 20 minutes, most preferably at least 30 min, and 240 minutes at the most.

Advantageously, at least one crushing device 21 is used for intermediate crushings, i.e. crushing between belts 22 of the thermal drying device 20. A crushing device 21 may be, for example, a crusher, a grinder, or a shedder. The crushing device 21 is preferably placed at the end of the belt 22, in which device the material is typically homogenized into particles of a desired size and distributed to the next belt into a porous layer of a desired thickness. The crushing device 21 is typically a tapered funnel, at the bottom of which rotates an axis or several axes, into which are attached "pegs" that crush the material. The crushed material preferably falls onto the next wire from the bottom of the crushing device 21. In an example, the crushing device 21 is of another type than the one presented above. The layer thickness after intermediate crushings is advantageously between 20 and 200 mm.

The capacity of the thermal drying device 20 depends substantially on the dry solids content of the fibril cellulose to be dosed into the thermal drying device. Therefore, the dry solids content of the input fibril cellulose material for the thermal drying device is advantageously at least 2% or at least 3%, more preferably at least 4% or at least 5%. There is typically a clear change in the dry solids content curves (water evaporation rates) at about 10% dry solids content in such a way that dry solids content increases typically faster after that point (when same temperature is used), thus, the bigger the dry solids content is, the better may be the production efficiency.

The layer thickness of each of the belts 22 is a question of optimization between the desired dry matter and production amounts. The capacity of the thermal drying device can be controlled by means of

- drying area of the belt(s),
- number of the belts,
- rotation speed of each of the belts,
- dispensing amount of the chemically modified fibril cellulose 11*a*,
- heated, air flow rate and/or
- temperature of the heated air flow.

Because the layer thickness advantageously increases after the first wire, the other wires typically move slower than the first wire.

For example, if an amount of 100 kg/h fibril cellulose material is dried from the concentration of 2.5% to the concentration of 20%, the fibril cellulose may require approximately 50-100 $m^2$ belt areas depending, among other things, on the air flow being used, the temperature of the air flow, and moisture of the air flow.

The thermal drying device preferably comprises from 2 to 7, preferably from 3 to 6 of the following online measurements:

- weight of the material to be concentrated,
- temperature of the air,
- temperature of the fibril cellulose material,
- temperature of the belt,
- moisture content of the air, moisture content of the fibril cellulose material, and air flow rate in order to measure and/or control the drying process.

Advantageously, a thick porous layer is formed on at least one belt 22 of the thermal drying device 20 in order to increase the water evaporation and also the capacity of the thermal drying device and, hence, to minimize the size of the drying device 20. The thickness of the fibril cellulose layer on the second belt and/or on the following belt(s) is preferably at least 5 cm, more preferably at least 7 cm.

The thermal drying device 20 used in the present invention is preferably a low-temperature belt drying device. The air flow may be led from the most concentrated fibril cellulose to the wettest fibril cellulose (shown in FIGS. 2 and 3). Alternatively, the air flow may be led, for example, from the wettest fibril cellulose to the most concentrated fibril cellulose.

Heated air 23 used in the drying device can be blown or sucked. The means 32 for forming heated air flow 23 preferably comprise at least one heat exchanger. Advantageously, the heated air 23 is generated by means of a heat exchanger from waste heat of a pulp mill, steam or electric power.

The temperature of the drying air in the thermal drying device 20 is advantageously at least 40° C. or 50° C., more preferable at least 60° C., and most preferably at least 70° C. However, the temperature is preferably not more than 120° C., more preferably not more than 110° C. In an example, the temperature of the chemically modified fibril cellulose material during thermal drying is preferably 80° C. at the most. Advantageously, the temperature of the heated air flow of the thermal drying device is between 40 and 80° C. The higher temperature is recommended due to the reasonable drying capacity. For example, by increasing the drying temperature from 40 to 60° C., the drying time can be nearly halved. If, for example, 80° C. temperature and air flow rate at 1 m/s is used, the evaporation rate in the beginning of the multilayer drying can be about 55 kg ($H_2O$)/h, per $m^2$, which decreases to about 15 kg ($H_2O$)/h, per $m^2$ at 60% dry solids content.

Heated air flow rate is preferably at least 0.2 m/s, more preferably between 0.2 m/s and 1.0 m/s, and most preferably between 0.25 m/s and 0.50 m/s. Increasing the volume flow rate of the drying air will increase water evaporation and thus decrease the drying time. For example, using air velocity of 0.5 m/s instead of 0.25 m/s, the water evaporation may be approximately 45% higher in the beginning of drying.

The concentration of the cellulose fibril material to be dosed onto the first belt 22*a* of the thermal drying device is preferably at least 2%, for example between 2 and 4%. The concentration after the first drying step is preferably at least 5%, for example between 5 and 8%. If the dry matter content of the fibril cellulose material is more than 4%, for example due to the pre-drying device, the concentration after the first drying step is typically higher than said between 5 and 8%. After the first drying step, the fibril cellulose material is on the second belt of the thermal drying device 20.

After the thermal drying, i.e. the last drying and/or concentration step in the thermal drying device 20, the concentration of the fibril cellulose material 11*b* is preferably between 10 and 100%, more preferably between 15 and 35% or between 20 and 30%.

In the first thermal drying step, the chemically modified fibril cellulose material is advantageously extruded on the belt by nozzles forming bars. If the dry matter content of the chemically modified fibril cellulose is between 0.1 and 4%, the bar is advantageously in the form of a string. The diameter of a single string on the belt is preferably between 2 and 15 mm, more preferably between 5 and 10 mm. Advantageously, the chemically modified fibril cellulose strings are dried to predetermined dry solids content, after which they are cut or crushed, preferably into 0.1 cm to 2.0 cm clippings.

The size of the concentrated and/or dried fibril cellulose material clippings is, after the thermal drying device, preferably 5 mm at the most, for example between 1 and 5 mm, more preferably 3 mm at the most, for example between 2 and 3 mm.

There is preferably several crushing devices, for example three, four or five crushing devices, and the size of the clippings after first intermediate crushing step is advantageously between 1 and 3 cm, and/or the size of the clippings after the following crushing step is between 0.5 cm and 1.5 cm, and/or the size of the clippings after the last crushing step is between 1 and 5 mm.

If the dry matter content of the chemically modified fibril cellulose is at least 4%, more preferably at least 5% and most preferably at least 6%, the bar is preferably in the form of a layer. The layer preferably has a median thickness between 1 cm and 30 cm, more preferably between 3 cm and 20 cm, and most preferably between 5 cm and 10 cm.

There is preferably at least first step and second step in the thermal drying process, which second step can be followed by optional $3^{rd}$ or $4^{th}$ steps including advantageously additional crushing devices. In an embodiment, chemically modified fibril cellulose layer is formed from the clippings through which the heated air preferably flows, the thickness of the layer during the second, the third and/or the fourth thermal drying step being between 5 and 20 cm, for example between 8 and 13 cm. The moisture is dried off convectively and preferably passed on to the air flow.

When comparing the chemically modified fibril cellulose bars with different bar diameters, the evaporation in the beginning of drying is 2.5-fold in the case if the diameter of the bar is 10 mm instead of 20 mm. This will also be reflected in the shorter drying time of the extruded material. However, the capacity of drying per drying area is typically almost the same.

In an advantageous example, the dried and/or concentrated chemically modified fibril cellulose is redispersed before it is used. In another example embodiment, the dried and/or concentrated chemically modified fibril cellulose is used as such.

Figure 6:
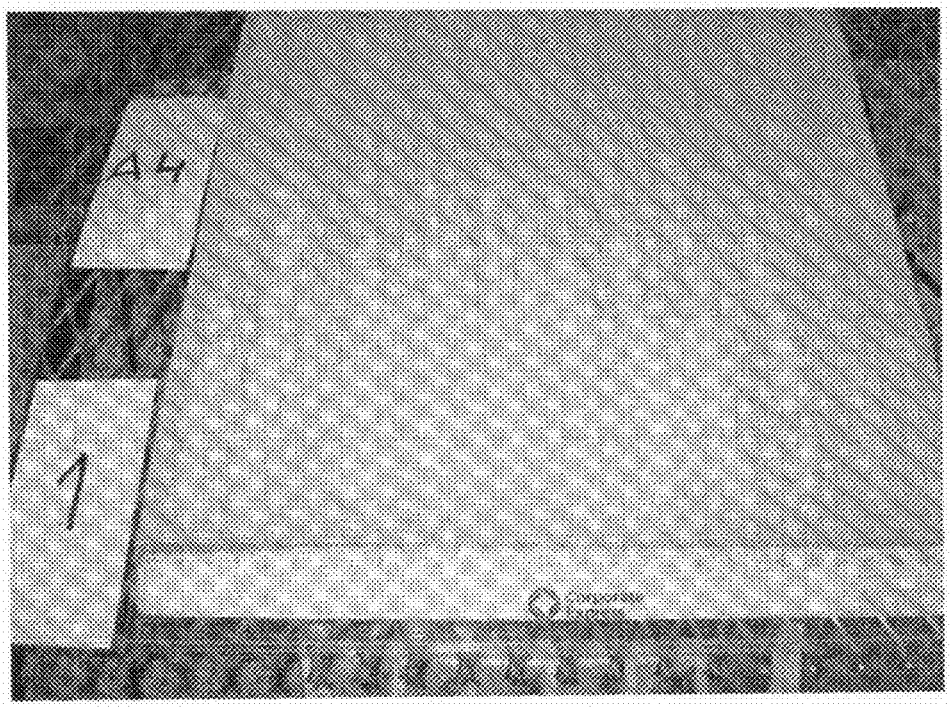
Figure 7A:
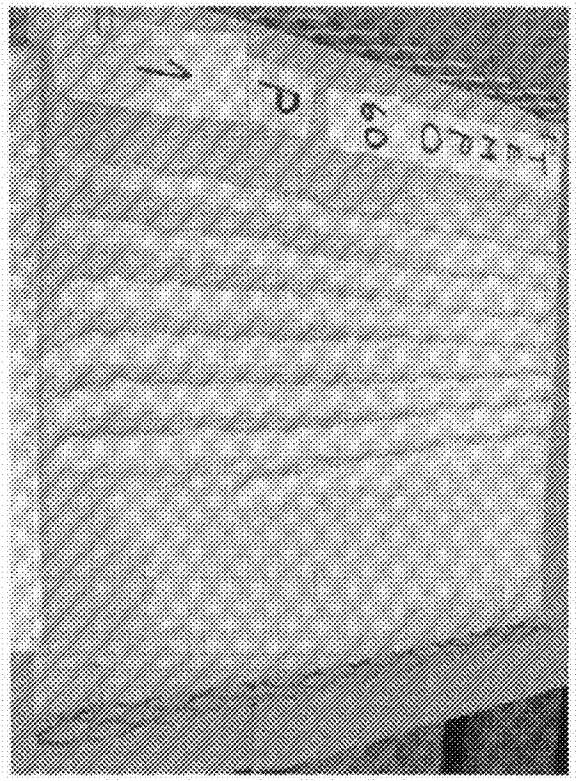
FIG. 7*a* shows chemically modified fibril cellulose samples before drying.
Figure 7B:
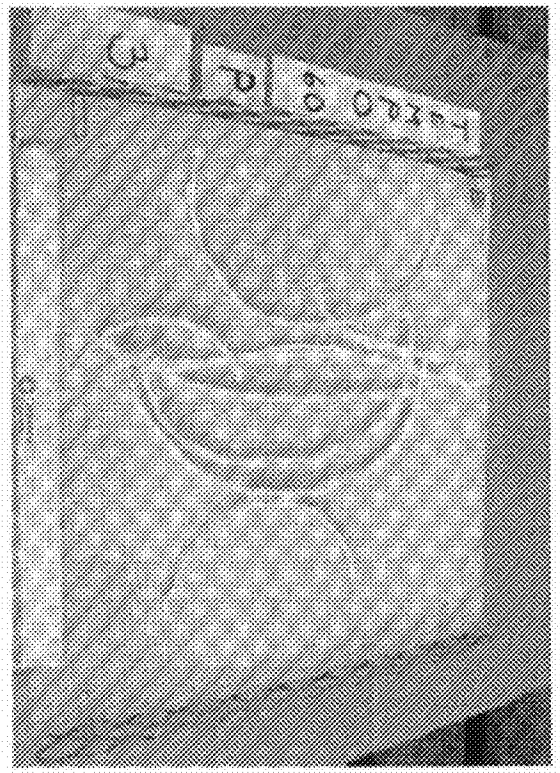
FIG. 7*b* shows chemically modified fibril cellulose samples after drying.

Some photos of the fibril cellulose are presented in FIGS. 6, 7*a* and 7*b*. FIG. 6 shows extruded material before the first thermal drying step on the first belt, FIG. 7*a* shows extruded anionic fibril cellulose samples on the first belt before the first thermal drying step, and FIG. 7*b* shows anionic fibril cellulose samples after the thermal drying process.

Figure 4:
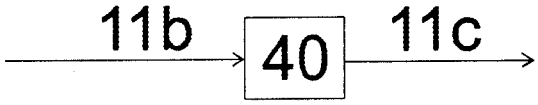
FIG. 4 shows schematically an example of the redispersing process.
Figure 5:
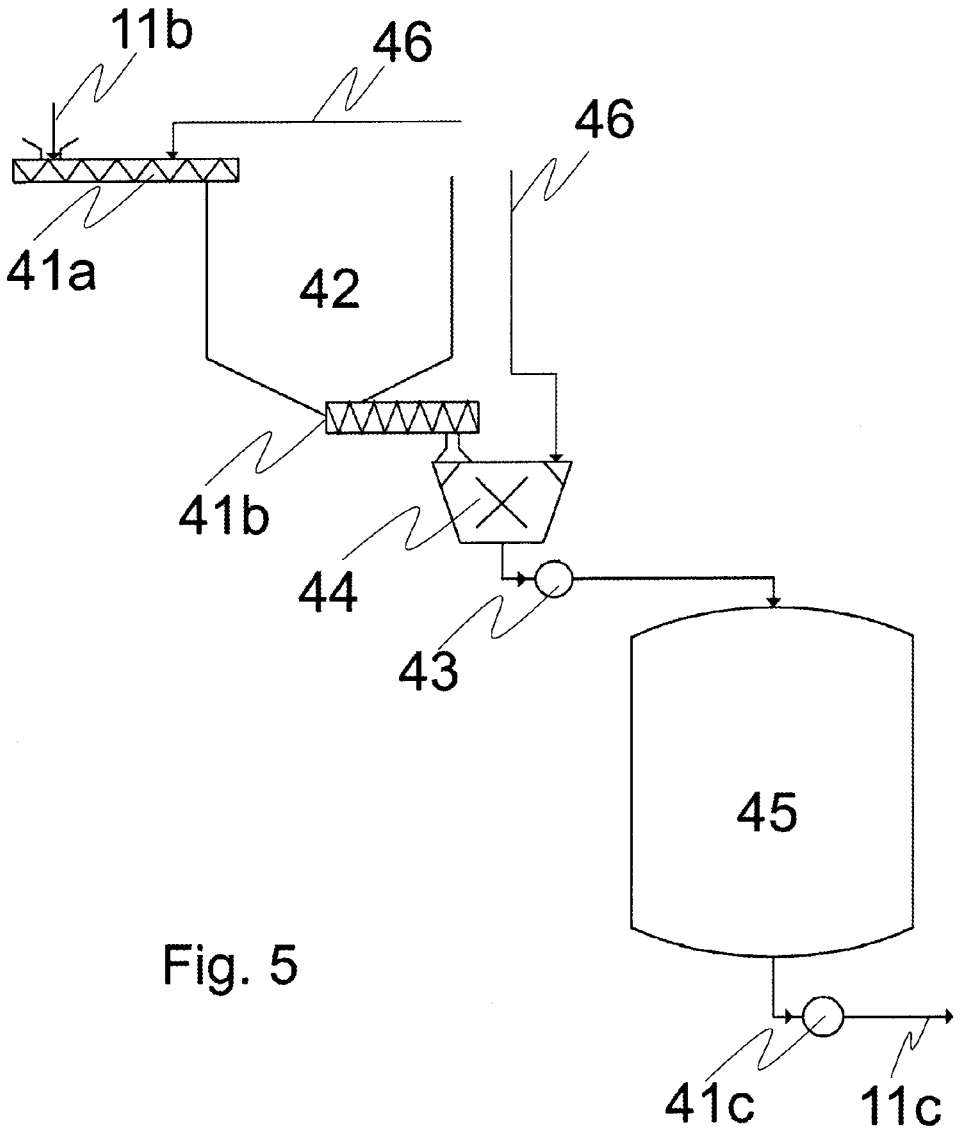
FIG. 5 shows an example arrangement for the redispersing.

FIG. 4 shows schematically a process where concentrated and/or dried chemically modified fibril cellulose material is redispersed. FIG. 5 shows an example arrangement of the redispersing process.

Redispersing of the chemically modified fibril cellulose 11*b* advantageously comprises two main steps, the first one being the hydration step in a hydration device 42, preferably a hydration tank, and the second one being mechanical dispersing of hydrated material in a dispergator 44. This is shown in FIG. 5. There may also be another device for the hydration step in addition or instead of the hydration tank 42.

The method and equipment preferably used for redispersion depends on the dry matter content of the concentrated and/or dried chemically modified fibril cellulose material. The material concentrated to 20% is more easily redispersed than a completely dry material. The concentrated and/or dried chemically modified fibril cellulose material is redispersed using liquid, preferably water, for example distilled water. The hydration device 42 such as the hydration tank may not be used, especially if the dry matter content of the fibril cellulose material to be dispersed is less than 20%, more preferably less than 15%.

The chemically modified fibril cellulose can form highly viscous dispersions (such as gels) in liquid after the thermal air drying process if high enough shear forces are used in redispersion process. The liquid preferably comprises or consists of water, i.e. the amount of the water in the liquid is preferably at least 80%, more preferably at least 90%.

The concentrated and/or dried chemically modified fibril cellulose material 11*b* is redispersed by using means 40 for redispersing the fibril cellulose material 11*b* into redispersed fibril cellulose material 11*c*. The means 40 for redispersing the fibril cellulose material 11 preferably comprise at least the hydration tank 42, and the dispergator 44.

In addition, the means 40 for redispersing the chemically modified fibril cellulose material 11 preferably comprise first means 41*a*, such as a first screw, for feeding concentrated chemically modified fibril cellulose to the hydration tank, and a second means 41*b*, such as a second screw, for conveying the chemically modified fibril cellulose from the hydration tank to the dispergator 44. After the dispersing step, the chemically modified fibril cellulose 11*c* is advantageously pumped to the storage tank 45 or directly to the site of use. Therefore, the arrangement preferably comprises third means 41*c*, such as a pipe and a pump, to convey the chemically modified fibril cellulose from the dispergator 44 for example to a fibril storage tank.

For the redispersion, heated dilution water 46 is preferably conveyed to the dispergator 44. Alternatively or in addition, heated dilution water 46 may be conveyed to the first conveyer 41*a* of the concentrated chemically modified fibril cellulose. The amount of the dilution water used has an effect on the dry solids content of the chemically modified fibril cellulose after redispersion.

Dispergator 44 by which incorporation of air-bubbles is minimised during mixing should preferably be used. The dispersion or gel may be deaerated under vacuum during and/or after redispersion in the dispergator 44 in order to remove air bubbles, especially if the formation of air-bubbles cannot be prevented.

Redispersion can be facilitated by allowing the material to hydrate in the hydration tank 42 for some time before the redispersion step in the dispergator 44. The retention time of the chemically modified fibril cellulose in the hydration tank 42 is preferably between 40 and 90 min, more preferably between 50 and 70 min.

Redispersion can be further improved by increasing the temperature during the hydration step from room temperature. The temperature of the hydration tank 42 is preferably between 30 and 60° C., more preferably between 35-50° C.

Advantageously, the dry solids content of the redispersed chemically modified fibril cellulose is 5% at the most, more preferably 3% or 2% at the most and most preferably 1% at the most, for example from 0.1 to 1%.

At laboratory scale suitable high-shear devices for redispersion (i.e. dispergator 44) are e.g. blenders such as the Waring blender or Büchi-mixer, rotor stator-type homogenizers such as the Ultra-Turrax or high pressure homogenizers. With these kinds of devices redispersion is very fast. With the Waring blender or Büchi-mixer, for example three 10 s mixing cycles are usually enough for obtaining a homogeneous dispersion with a high viscosity. Typically blade impellers, such as a Dispermat dissolver or a propeller impeller, do not provide high enough shear forces and are therefore not recommended for redispersion of concentrated or dried chemically modified fibril cellulose.

For redispersion at industrial scale, for example in-line rotor-stator type homogenizers can be used, such as Silverson® high shear in-line mixers. In an advantageous example, a rotor-rotor type homogenizer and/or a rotor-rotor type dispergator is used. Another commercial continuous dispersers that can be used for the re-dispersion are provided by, for example IKA series DR2000 or DRS2000.

Some lab-scale redispersion methods for chemically modified fibril cellulose concentrated to a dry matter content of 20-100% are presented in the following examples.

EXAMPLE 1

Anionic fibril cellulose was air-dried to a dry matter content of 26%. 0.5% fibril cellulose dispersion was made by adding 196.25 g distilled water to 3.85 g 26% fibril cellulose. The mixture was immediately redispersed in a Waring laboratory blender (LB20E*, 375 W) in a 500 ml glass container for 3×10 s. A 0.5% dispersion of the non-concentrated fibril cellulose with an initial dry matter content of 2% was made similarly as comparison. The air bubbles incorporated during mixing were removed from the dispersion under vacuum. The success of the redispersion process was evaluated by measuring the viscosity of the dispersion as function of shear stress with a stress controlled rheometer (TA Instruments, UK) using a vane geometry.

Figure 8:
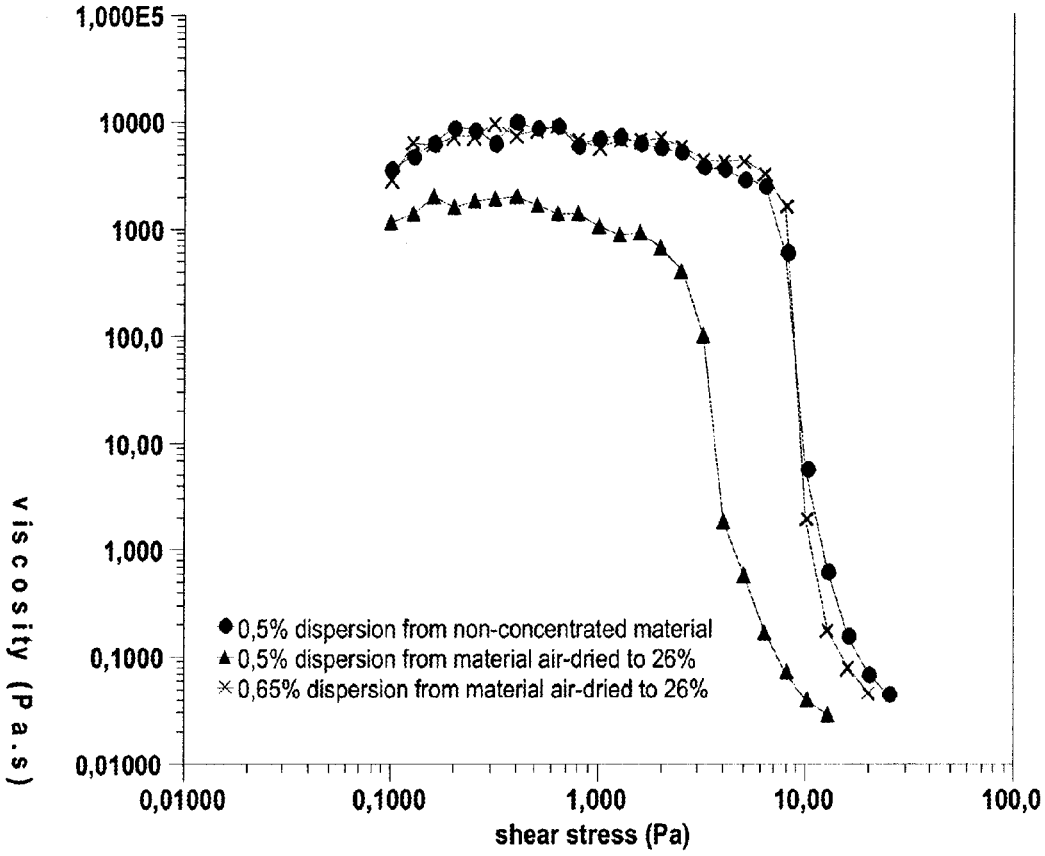

Mixing with the Waring blender was sufficient for producing a visually homogeneous dispersion from the concentrated material. The viscosity of the redispersed material at 0.5% concentration was, however, not as high as that of a 0.5% dispersion made from the non-concentrated material as shown in FIG. 8. By increasing the concentration to 0.65% a similar viscosity as with the non-concentrated material at 0.5% could be reached. Other ways of increasing the viscosity after redispersion is to allow the concentrated material to hydrate for some time before mixing with the Waring blender, to increase hydration temperature or to increase the mixing time. This is illustrated in Examples 2 and 3.

EXAMPLE 2

A dispersion of anionic fibril cellulose air-dried to 22% was made in distilled water at a concentration of 0.5% by allowing the material to hydrate under magnetic stirring for 1 h before it was mixed in Waring blender. Control dispersion was made from the non-concentrated (3.7%) material by mixing with the Waring blender for 3×10 s.

Figure 9:
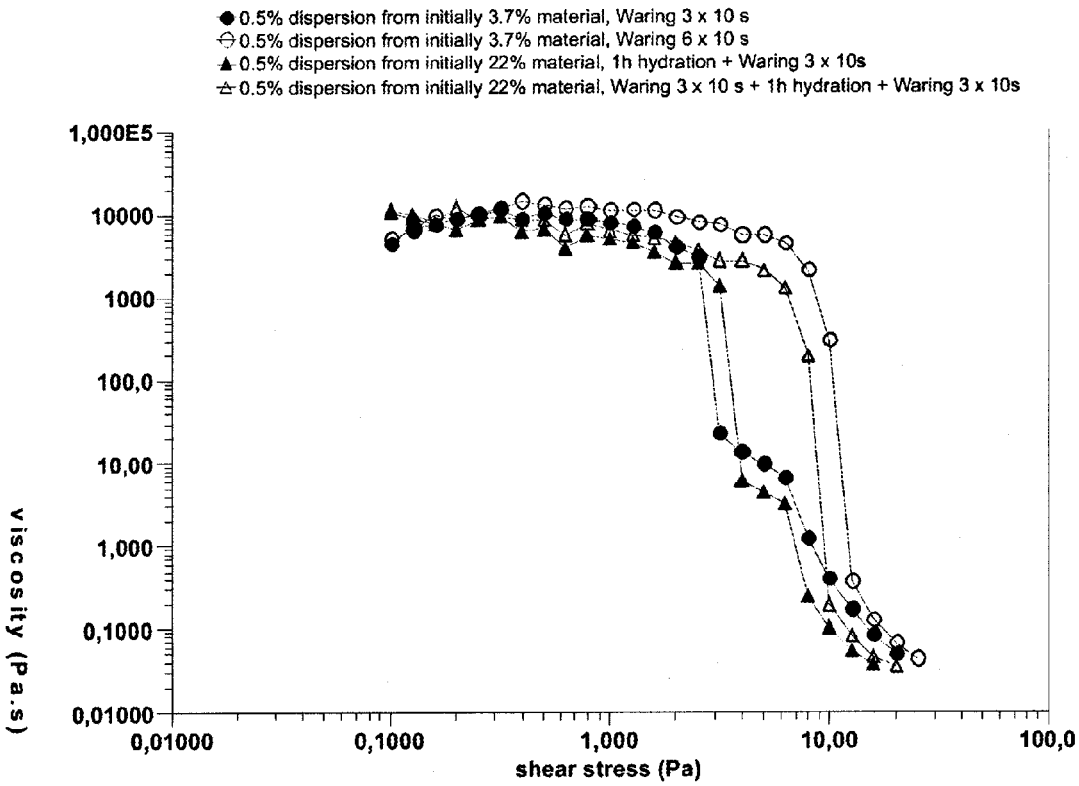

The dispersions prepared from 3.7% and 22% fibril cellulose showed identical flow behaviour in a wide shear stress range as shown in FIG. 9. The 1 h hydration period before mixing with the Waring blender obviously facilitated the redispersion of the fibril cellulose concentrated to 22%. An even better result was obtained when the 22% material was mixed with the Waring blender for 3×10 s prior to the hydration period and once more (3×10 s) after hydration. Dispersion with a higher viscosity could also be prepared from the non-concentrated (3.7%) material by increasing the number of 10 s mixing cycles with the Waring blender from 3 to 6.

EXAMPLE 3

Anionic fibril cellulose was air-dried to 100%. A 0.5% dispersion of the material was prepared in distilled water by allowing it to hydrate for 1 h under magnetic stirring at room temperature before it was dispersed with a Büchi-mixer (B-400, max 2100 W, Büchi Labortechnik AG) for 3×10 s.

Figure 10:
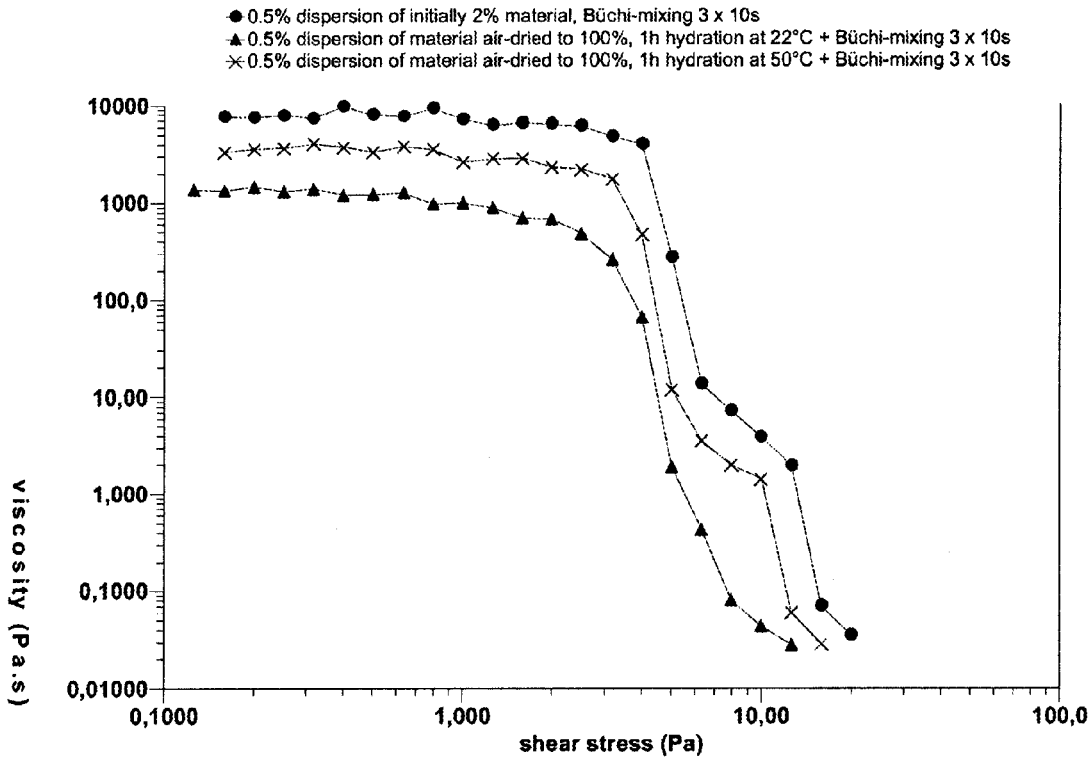

The viscosity of the dispersion prepared from the 100% material was not as high as that of dispersion made of non-concentrated material as can be seen from FIG. 10. The result was markedly improved when the temperature during hydration was increased from room temperature to 50° C.

The following example demonstrates the need of high enough shear forces in redispersing concentrated fibril cellulose.

EXAMPLE 4

Anionic fibril cellulose was air-dried to 27%. A 0.5% dispersion of the material was prepared in distilled water by mixing with a) a Waring blender for 10 s at maximum speed, b) a Waring blender for three 10 s mixing cycles at maximum speed, c) Dispermat dissolver (VMA-Getzmann GMBH) for 1 h at 3000 rpm or d) a Büchi-mixer for three 10 s mixing cycles.

Figure 11:
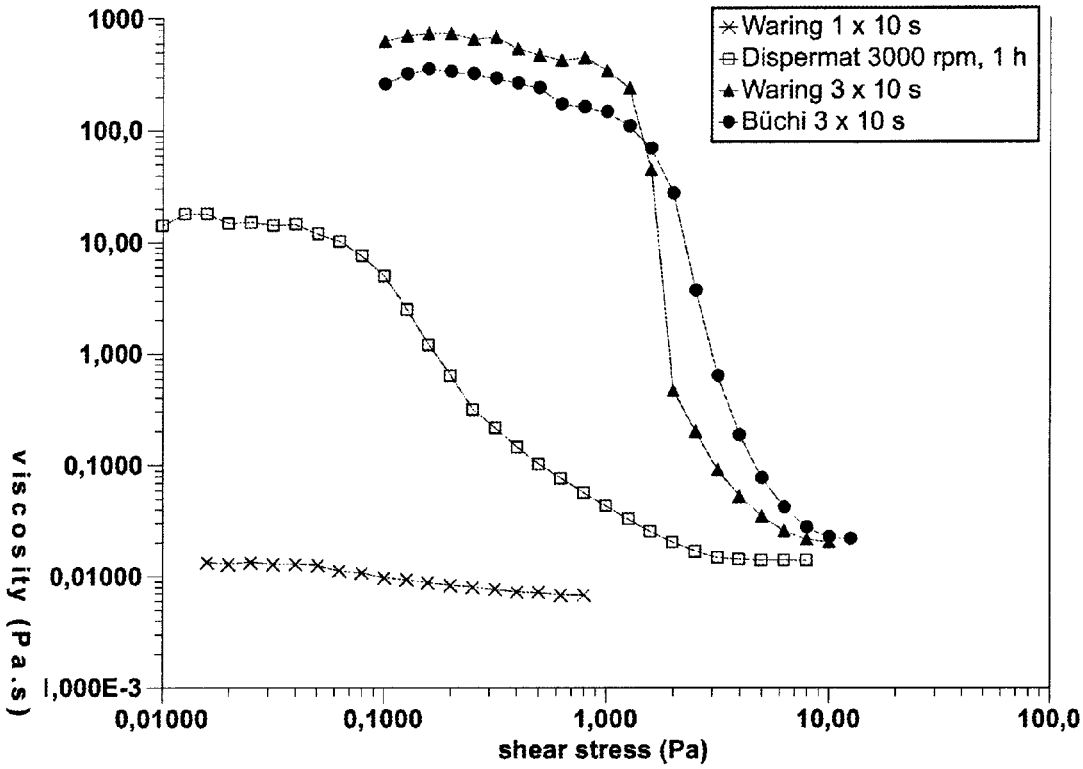

From FIGS. 12*a*-12*d* it can be seen that visually homogeneous dispersions could be prepared with all the other redispersion methods but with the shorter treatment (1×10 s) with the Waring blender. Although the Dispermat treated dispersion looked good by eye, its viscosity remained clearly lower than that of the dispersions made by the more powerful redispersion methods (Waring 3×10 s and Büchi-mixer) as shown in FIG. 11. Microscopic examination (FIG. 13*a*-13*d*) of the dispersions revealed that the fibril cellulose was not as well dispersed with the Dispermat than with the Waring blender (3×10 s) or Büchi-mixer.

One skilled in the art readily understands that the different embodiments of the invention may have applications in environments where optimization of processing fibril cellulose material is desired. It is also obvious that the present invention is not limited solely to the above-presented embodiments, but it can be modified within the scope of the appended claims.

Fibril cellulose may comprise microfibrils and nanofibrils. Redispersing fibril cellulose is associated with the existence of numerous hydrogen bonds between the fibrils, which are created during drying. Number of hydrogen bonds per weight unit of cellulose is directly associated with the morphology of the said fibrils, and more specifically proportional to their specific surface; the greater the specific surface, the larger the number of hydrogen bonds per weight unit of cellulose. The cellulose fibrils obtained from wood are derived from secondary walls, and they have greater than 70% degree of crystallinity. After chemical modification or fibrillization the degree of crystallinity of fibril cellulose material may be greater than 55%. Fibril cellulose comprises amorphous fibrils. Amount of amorphous fibrils in fibril cellulose is less than 50%. The cellulose fibrils obtained from secondary walls do not have the characteristics of amorphous fibrils, but rather, have the characteristics of microcrystalline fibrils.

The invention claimed is:

1. A method for processing chemically modified fibril cellulose, comprising introducing chemically modified fibril cellulose material to a thermal drying device comprising at least two belts and at least one crushing device in such a way that the fibril cellulose material forms at least one bar onto the first belt, crushing the chemically modified fibril cellulose material in the crushing device after the bar formation onto the first belt, drying and/or concentrating the chemically modified fibril cellulose material on the second belt after, the crushing step, and dewatering the chemically modified fibril cellulose material on at least one of the at least two belts using heated air flow having a temperature of at least 40° C. in order to concentrate and/or dry the chemically modified fibril cellulose material in such a way that the dry solids content of the fibril cellulose material after the thermal drying device is at least 10%.

2. The method according to the claim 1, wherein the first belt is a wire and at least part of the heated air flows through the first belt.

3. The method according to the claim 1, wherein a viscosity of the fibril cellulose introduced to the thermal drying device is at least 10000 mPas in a supplying consistency of said fibril cellulose, wherein dry matter content of said fibril cellulose is between 0.5-9%.

4. The method according to the claim 1, wherein fibril cellulose material on the first belt of the thermal drying device covers at least 30% of the drying area of the first belt.

5. The method according to the claim 1, further comprising supplying the chemically modified fibril cellulose material to a feeding tank, conveying the chemically modified fibril cellulose material from the feeding tank to the thermal drying device, wherein a mono pump is used in the conveying process.

6. The method according to the claim 1, further comprising extruding the chemically modified fibril cellulose material onto the first belt by a nozzle forming the bar.

7. The method according to the claim 1, wherein the bar is in the form of a string, and there are several strings on the first belt, each of the strings having a diameter between 2 and 10 mm.

8. The method according to the claim 1, wherein the bar is in the form of a layer comprising clippings, and a thickness of the layer is between 5 and 20 cm.

9. The method according to the claim 1, wherein the bar is in the form of a single layer.

10. The method according to the claim 1, wherein the heated air is generated by means of a heat exchanger from waste heat of a pulp mill, steam or electric power.

11. The method according to the claim 1, further comprising pre-drying the chemically modified fibril cellulose in a pre-drying device prior to the thermal drying device in such a way that the dry matter content of the fibril cellulose introduced to the thermal drying device is at least 5%.

12. The method according to the claim 1, comprising following said dewatering, introducing said chemically modified fibril cellulose material having a dry solids content of at least 10% to a hydration device, redispersing the chemically modified fibril cellulose into liquid in an dispergator in order to achieve chemically modified fibril cellulose having a dry matter content between 0.01and 5%.

13. The method according to the claim 12, further comprising wetting the chemically modified fibril cellulose material having a dry solids content of at least 10% in the hydration device, and conveying the wetted chemically modified fibril cellulose material to the dispergator.

14. The method according to the claim 12, wherein the redispersed fibril cellulose has the zero shear viscosity of 1000 to 50000 Pas and yield stress of 1-30 Pa.

15. The method according to the claim 12, wherein the fibril cellulose will give, when redispersed in water, viscosity that is at least 60%.

* * * * *